United States Patent [19]

Lerner et al.

[11] Patent Number: 4,955,177

[45] Date of Patent: Sep. 11, 1990

[54] CARTON FLAP FOLDING APPARATUS

[75] Inventors: Joseph S. Lerner; David Krukas, both of Kings Park, N.Y.

[73] Assignee: The Loveshaw Corporation, Ronkonkoma, N.Y.

[21] Appl. No.: 428,346

[22] Filed: Oct. 27, 1989

[51] Int. Cl.[5] ..... B65B 7/20; B65B 51/06

[52] U.S. Cl. ..... 53/137; 53/374; 493/117; 493/183

[58] Field of Search ..... 53/137, 374, 491, 381 R; 493/183, 453, 437, 460, 117, 116; 156/486

[56] References Cited

U.S. PATENT DOCUMENTS

| | | | |
|---|---|---|---|
| 3,382,645 | 5/1968 | Loveland et al. | 53/374 X |
| 3,466,843 | 9/1969 | Mumper | 53/137 |
| 3,505,774 | 4/1970 | Gidge | 53/374 X |
| 4,039,367 | 8/1977 | Warshaw et al. | 156/486 |
| 4,640,731 | 2/1987 | Lerner et al. | 493/117 X |

*Primary Examiner*—James F. Coan

*Attorney, Agent, or Firm*—George J. Brandt, Jr.

[57] ABSTRACT

Flap folding plates are provided for use with a carton taping machine, the plates normally being disposed in upright orientation and maintained such by bias applied thereto. Further the plates are arranged so that the top corner structure at the sides of the carton strike the plates to cause the plates to pivot rearwardly in folding movement against the carton side flaps thereby absorbing at the said corner structures the force that might otherwise be transmitted to the front edges of the upright side flaps which could result in tearing or ripping of the side flaps where said flaps are joined to associated side walls.

8 Claims, 6 Drawing Sheets

CARTON FLAP FOLDING APPARATUS

BACKGROUND OF THE INVENTION

In the tape sealing of rectangular shipping cartons, a preliminary requirement involves folding of the carton front, rear and side flaps from upwardly directed positionings of each to closed lateral positions wherein the side or major flaps overlay the front and rear (minor) flaps with longitudinal edges of the folded side flaps defining a, e.g., upper carton seam, sealing tape thereafter being applied in a sealing course over this seam with anchorage lengths of the tape course being adhered to portions of the carton front and rear walls. By simplest means, the flap folding can be hand effected by a machine operator immediately prior to passing the closed contents-containing carton onto the conveyor of a taping machine. This procedure is in most cases undesirably labor intensive for continuous carton sealing operations so flap folding devices are used, these devices generally being part of the tape sealing machine or an adjunct thereto so that passage of an open flap carton through the taping operation will result automatically in operation of these flap folding devices to effect flap closure before the carton reaches a tape applying station. U.S. Pat. No. 3,382,645 discloses a form of such flap folding devices, which devices comprise, inter alia, front (minor) flap folding arm 146, obliquely downwardly extending folding plows 233 for folding the carton side (major) flaps and a rear (minor) flap folding kicker 161. Normally upwardly disposed plates which are pivoted near their bottoms also can be used to effect folding of the carton side flaps. When the front edges of these side flaps on a forwardly travelling carton engage the plates, the plates are caused to pivot and with that pivoting movement fold down and inward the carton side flaps.

While the aforementioned devices employed for side flap folding operate satisfactorily for the intended purpose, problems can be encountered in certain instances in their use. These devices operate on the basis of the front edges of the side flaps of a forwardly travelling carton coming into contact with an obstruction. i.e., a fixed or rigid folding plow or twisted folding rod, or a plate pivoted at its bottom, to initiate and carry out the side flap folding movement. Where heavy material carton structures are involved, i.e., double and triple wall corrugated material cartons, the stiffness of this material as present in the upstanding side flaps can lead to failure of the side flaps to bend or bend properly on contacting the folding devices so that due to this malfolding coupled with momentum effect in the travelling carton, there can result undesirable happenings such as a ripping of the side flaps away from their associated carton side walls or formation of a new false score in the carton structure or only partial flap folding and consequent partial flap sealing. In these prior devices, the whole reaction force of the engagement of the side flaps with the folding devices is transmitted to the side flaps. In addition to the heavy, stiff nature of carton materials, the score line provided where a side flap meets an associated carton side wall and which is intended to function as a flap folding axis may be of low quality so that the side flap will not start to fold down and inward when it engages the folding device but rather impact the device and tear or rip away from the associated side wall where it has joinder thereto.

The above-described problems also are prevalent in respect of a class of rectangular shipping cartons which are formed from corrugated paperboard stock fabricated in the Far East and manufactured from a material base which lacks a certain quality of stiffness and strength to resist tearing, e.g., paperboard made from rice and rice plant fibers.

Thus it is to be understood that flap folding devices as are known can be a problem not only with use of cartons made from paperboard stock which is too stiff or strong but also with those made from paperboard which is not stiff enough and lacks tear-resistant strength because in both situations, use of such flap folding devices frequently results in unwanted and unacceptable flap damage.

OBJECTS AND SUMMARY OF THE INVENTION

An object of the invention is to provide an improved flap folding apparatus for folding down and inwardly from upstanding positions, the side flaps of a rectangular shipping carton to a lateral closed positioning of same relative to the carton side walls so that a tape sealing course can thereafter be applied over a seam at the top of the carton defined by confronting longitudinal edges of said side flaps.

Another object of the invention is to provide simply constructed yet highly effective carton side flap folding apparatus which is readily and conveniently embodied in or as an adjunct to a carton taping machine.

A further object of the invention is to provide carton side flap folding apparatus which functions in such manner as to effect optimized side flap folding without hazard of tearing or ripping the side flaps at the point of joinder of said flaps to their associated carton side walls or otherwise damaging the flaps when the side flaps come into contact with the folding apparatus during passage along a forwardly directed travel course.

A still further object is to provide carton side flap folding apparatus which utilizes highly strengthened structure of the carton to initiate side flap folding by engaging an arrangement of flap folding plates with the said strengthened structure so that this structure rather than front edges of the side flaps absorb the engagement impact requisite to bring about folding plate movement in a flap folding direction.

In an advantageous form, the apparatus of the invention comprises a pair of flap folding plates carried on a head beam structure a distance above the conveyor of a taping machine, the plates being located upstream of a taping mechanism on the machine. The plates are each mounted to rotate about a respective one of a pair of plate support axes, such axes being disposed to extend obliquely down in the carton travel direction and in convergence toward each other. Tension springs are connected with the head beam structure and the plates serve to apply bias force to the plates tending to normally dispose the plates in an upright orientation. The plates are carried on rods fixed to the head beam structure, the plates, e.g., having clip or sleeve means thereon which sleeve means embrace the rods so that the plates are rotatably mounted on the rods. The rods define the pivot axes, the plates having a first part which in upright plate orientation extend above their pivot axes and a second part which extends below such axes. The second parts of the plates have an appreciable downward reach so that they extend at least some distance below the carton top corner structure defined by the intersection of the carton front wall with the side walls. This provides that when a carton being conveyed in a forward direction on the machine conveyor comes into contact with the folding plates, it is a highly strengthened structure of the carton, i.e., the top corner structure which makes contact with the second parts of the plates to start the rearward pivoting movement of the plates to initiate and fulfill side flap folding. The front edges of the upwardly directed side (major) flaps also will engage with the plates but the main contact impact is absorbed by the carton corner structure so that while the front edges of the side flaps are in contact with the folding plates during the folding operation, the impact loading transmitted to the side flaps is slight by comparison with that on the corner structure so that tearing or ripping of the side flaps is obviated and any false folding as well. As the folding plates are pivoted rearwardly by the action of carton forward travel they maintain contact with the side flaps at the front edges of each and produce the inward and downward folding of these flaps to closed lateral position relative to the carton enclosure. The carton in passing downstream of the plates will arrive at the machine taping station where taping of the carton is carried out, e.g., with taping mechanism of the type disclosed in U.S. Pat. No. 4,039,367.

The head beam structure comprises an elongated member extending longitudinally of the conveyor and has a rear end disposed rearwardly a distance of the flap folding plates mounting location. This elongated member has a forwardly and downwardly inclined rear end surface which serves as a flap folding shoe which is engaged by an upwardly directed front (minor) flap of a forwardly moving carton and causes folding downwardly and rearwardly of this front flap to a closed position in which it will lie below the side flaps when the latter are folded. The machine also can be provided with a carton rear flap folding kicker of the type disclosed in U.S. Pat. No. 3,382,645.

The flap folding plates can be used for flap folding purposes with cartons having a range of carton widths. For example, the plates are arranged such that allows flap folding to be carried out on cartons having widths in a range of anywhere from 3 or 5 inches up to 20 inches or more. Where cartons of varying heights are intended to be used, the head beam structure is so supported that it can be adjusted vertically over a range of heights above the conveyor.

The flap folding apparatus also can be used for folding the bottom side flaps on a carton. In such instance the plates would be supported at a location beneath a carton forward travel course and the arrangement would be opposite in certain respects to that where the apparatus is used for folding top side flaps. For example, this reversal of component dispositions would mean that the bottom side flap folding plates would be pivotable about axes which extend obliquely upwardly and converge, the bottom corners at the carton front would engage second plate parts which have appreciable upward reach, the plates would pivot forwardly and the bottom side flaps would be folded inwardly and upwardly by the folding plates.

The invention accordingly comprises the features of construction, combination of elements, and arrangement of parts in carton flap folding apparatus which will be exemplified in the construction hereinafter set forth and the scope of the invention will be indicated in the claims.

BRIEF DESCRIPTION OF THE DRAWINGS

A fuller understanding of the nature and objects of the invention will be had from the following detailed description taken in conjunction with the accompanying drawings in which.

Throughout the following description, like reference numerals are used to denote like parts in the drawings.

DETAILED DESCRIPTION OF THE PREFERRED EMBODIMENT

Figure 5:
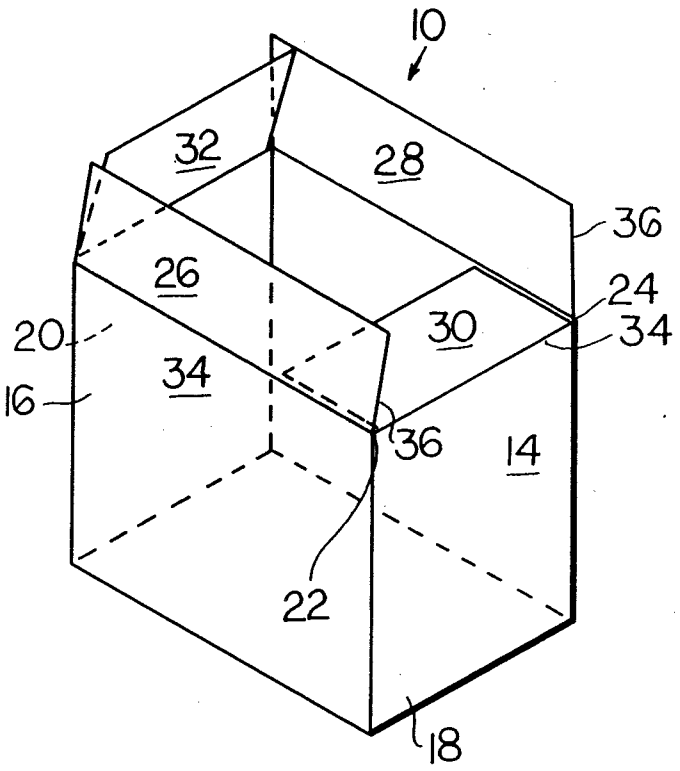
FIG. 5 is a perspective view of a shipping carton with the front flap folded and the rear flap partly folded but the top side flaps upwardly extending.

FIG. 5 depicts a rectangular shipping carton 10 of the type with which the flap folding apparatus 12 (FIG. 1) is used. Carton 10 has opposite upstanding side walls 14, 16 which are joined together at their ends with upstanding transversely extending front wall 18 and rear wall 20, the intersection of the side walls and front and rear walls defining relatively strengthened corner structures at these intersections, e.g., the top corner structures 22, 24 at each side of the front of the carton. The carton has upper side flaps 26, 28 (shown extending generally vertically upwardly) formed as integral members with the respective side walls 14, 16 a front flap 30 made integral with front wall 18 and a rear flap 32 integral with rear wall 20. Front flap 30 is shown in a folded closed position and rear flap 32 is disposed in its upwardly directed position before same is folded down incident the closing and eventual tape sealing of the carton. Score lines 34 are provided in the carton where the flaps are joined to the various walls, these score lines serving to define hinge points or bend lines about which the flaps are to be folded. The side flaps 26, 28 have front edges 36 and carton closure is effected by first closing or folding down the front and rear flaps and then the side flaps to closed lateral positions overlaying the front and rear flaps. The long edges of the folded side flap define a carton top seam over which a sealing tape course is applied with that sealing course being anchored at each end down some distance on the respective carton front and rear walls. Folding flaps to "closed or lateral" position will be understood as meaning folding these from upright position to one where the flaps are generally perpendicular to the carton side and front and rear walls.

The carton 10 with which the flap folding apparatus can be used can be made from a wide range of paperboard materials inclusive of those used for rugged two and three ply corrugated paperboard stock to materials which are not particularly strong and have low tear-resistant strength. The flap folding apparatus can be used with cartons 10 having a varying range of dimensions. For example, carton widths could be in a range of 3 or 5 to 20 inches or more, and heights in a range of 2 or 3 to 30–36 inches or more. In describing the flap folding apparatus 12 next, continuous reference is made to FIGS. 1–4.

Figure 1:
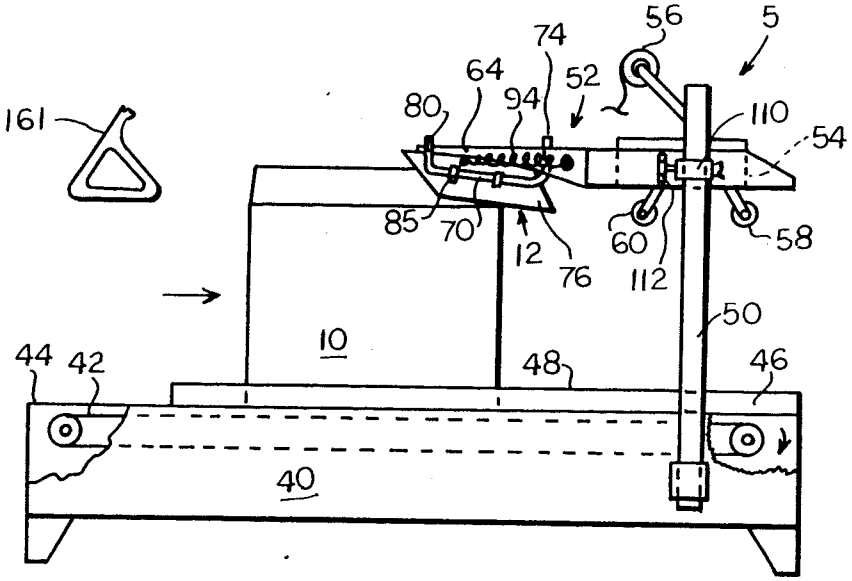
FIG. 1 is a side elevational view of a carton taping machine which has been provided with flap folding apparatus in accordance with the invention, there being shown a forwardly travelling carton on which the side flaps thereof have been folded to an almost closed position, the taping mechanism of the machine being located a distance downstream from the folding plates.
Figure 3:
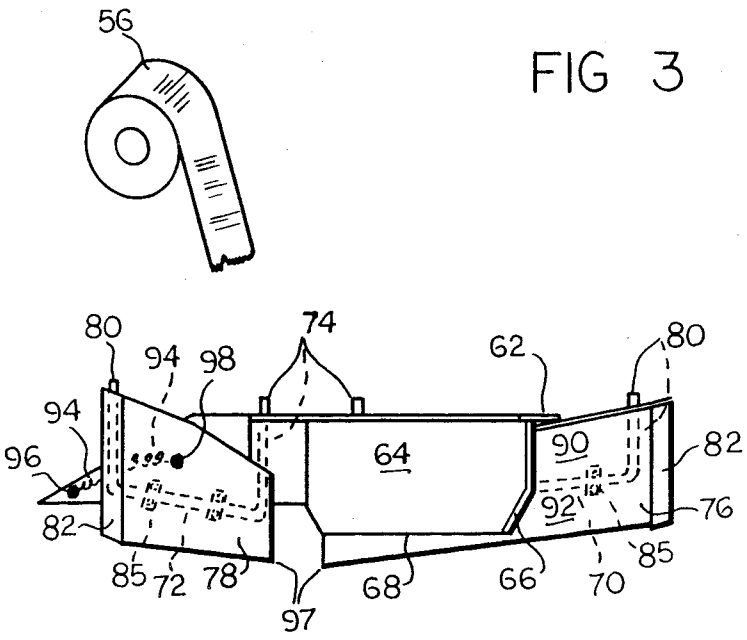
FIG. 3 is a perspective view similar to FIG. 2 but the carton not being shown and the folding plates being disposed in normal upright orientation.

The flap folding apparatus can be provided as an adjunct unit in a carton taping operation which includes carton taping machine 5 such as being a satellite component connected by roller conveyor to the entrance to machine 5, or it can as shown in FIG. 1, be embodied as part of the machine itself. The taping machine 5 which is only one of many types with which the invention can be used includes base structure 40 on which is mounted a forwardly travelling conveyor 42, the conveyor having an entrance end as at 44 and a discharge end as at 46, a carton 10 entering onto the conveyor being conveyed forwardly to effect flap folding and tape sealing before it discharges from the conveyor. Side guidance rails 48 can be provided on the machine as well as a support standard 50 located near the conveyor discharge end and employed for mounting adjustably vertically thereon of a head beam structure 52, the adjustment being provided, e.g., by a bracket 110 carried on the head beam which encircles the standard and a locking wheel 112 for locking the bracket in selective positions. Head beam member 52 in the forward end part mounts a taping cartridge 54 of the type disclosed in U.S. Pat. No. 4,039,367, that taping cartridge including, inter alia, a tape stock 56 and a pair of roller tipped tape applying arms 58, 60 which as the carton passes under the cartridge apply pressure sensitive face sealing tape in a sealing course to the top of the carton in the manner as described in the '367 patent. The rear part or section of the head beam member 52 (as best seen in FIG. 3) comprises a flange 62 and a relatively deep web 64, the rear end of the web having a downwardly and forwardly inclined edge 66 which serves as a folding shoe to fold down the front flap 30 of a forwardly travelling carton when it comes in contact therewith, the folding occurring prior to the time the soon-to-be described flap folding plates are engaged by said carton. Further the lower edge 68 of the web serves as a "suppressor" to keep the front flap, as the side flaps are being folded, in its lateral folded position. The rear flap 32 also is folded down before side flap folding takes place, the kicker 161 (FIG. 1) being used for that purpose and functioning as described in U.S. Pat. No. 3,382,645. The suppressor edge 68 also serves to maintain rear flap 32 folded as it passes thereunder and for which purpose the rear part of the head beam can be provided with a greater rearward reach, e.g., to an extent as shown in dashed lines in FIG. 4. In this manner suppressor edge 68 will be positioned to engage the carton folded down read flap as soon as that flap has been folded by the kicker plate.

Figure 2:
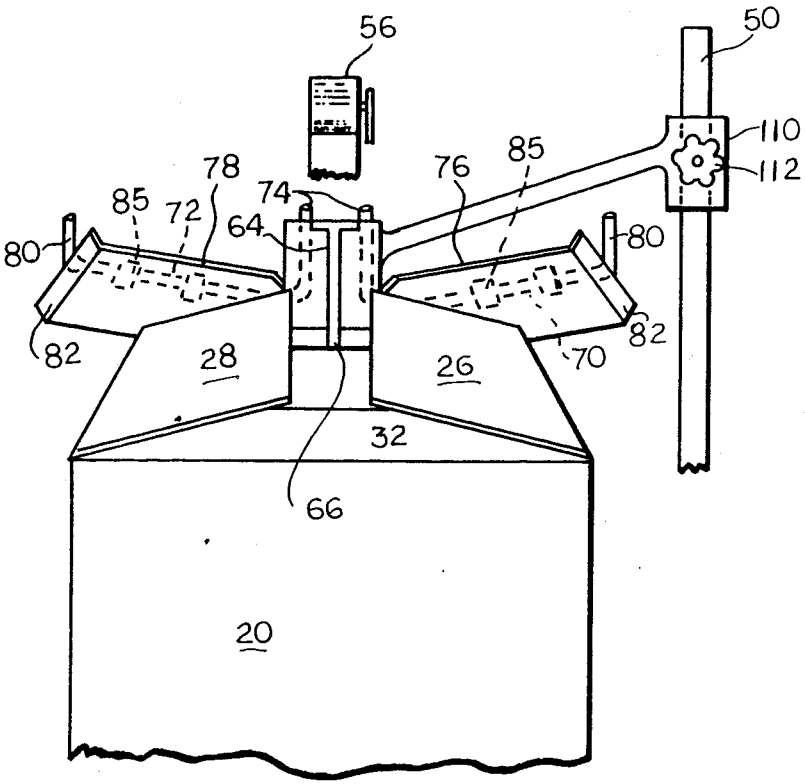
FIG. 2 is a fragmentary perspective view looking in the forward direction of the machine from the conveyor entrance end and illustrating the manner in which the folding plates pivot rearwardly to fold down the carton side flaps.

The head beam member forward part is of widened character as compared to the flange and deep web configuration of the beam member rear part and it is from that widened part that the flap folding apparatus 12 is mounted reference being had to FIGS. 2 and 3 in elaborating in more detail as to this mounting. A pair of rods 70, 72 are mounted to the head beam member, these rods including each a front upright section 74 fixedly secured to the head beam member. The front sections merge with elongated main sections which main sections are inclined obliquely downwardly in the forward direction from the rear of the head beam member and converge toward each other as may be best seen from the FIG. 2 depiction of same wherein these main sections appear in dashed lines as in said FIGURE they are on the forward side of the flap folding plates 76, 78. Each rod 70, 72 also includes an upright rear end section 80 bent substantially at a right angle to its associated main section. The main sections of the rods 70, 72 define pivot axes for the flap folding plates. These pivot axes are as can be seen, inclined oblique to the carton forward travel path, the inclination being down in regard to plates used for folding top side flaps and up for plates used for folding bottom side flaps.

Flap folding plates 76, 78 are elongated relatively widened thin members made of stainless steel, light sheet metal or thermoplastic and the ends of each are provided with a stiffening end flange 82, the respective plates 76, 78 being mounted on the respective rods 70, 72, the plate mounting being in the form of spaced clip or sleeve means 85 carried on the plates and encircling or embracing the rod main sections so that the plates are rotatable on the fixed rods. Since the rod main sections are obliquely disposed, the folding plates have the same oblique character, i.e., they are rotatable in envelopes which are oblique and converging, this being evident from FIGS. 2 and 3.

Figure 4:
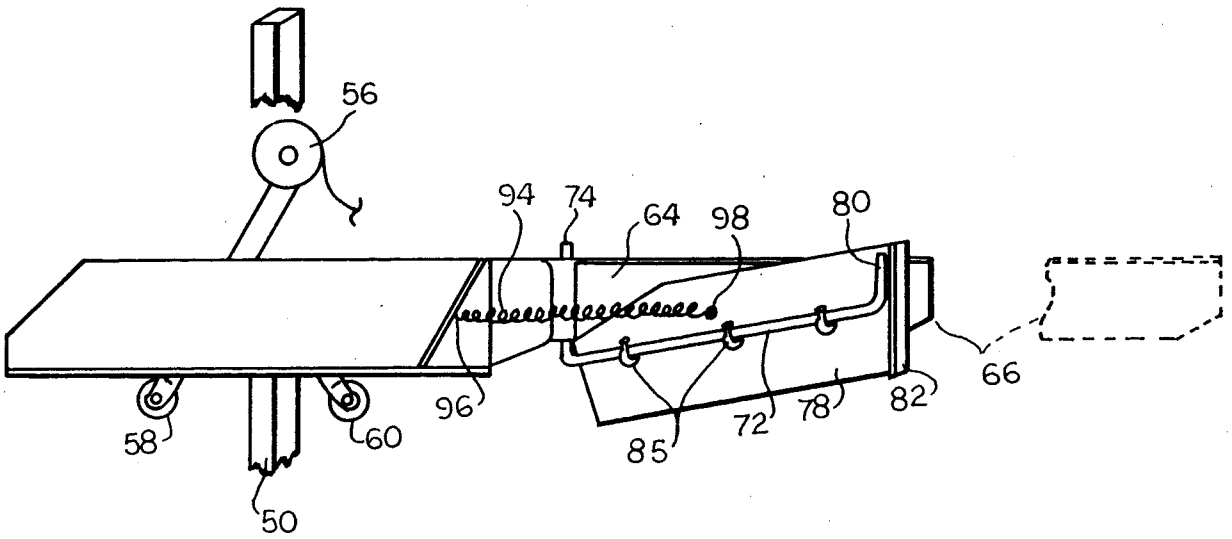
FIG. 4 is a view of an upper part of the machine shown in FIG. 1 as viewed from the machine side opposite that shown in FIG. 1.

As can be seen from FIG. 4, the plates 76, 78 are carried on the rod main sections in such way that the expanse of the plates is generally symmetrically arranged about the associated plate pivot axis. Thus each plate has a first part 90 which when the plates are in upright orientation, is disposed above its associated pivot axis and a second part 92 disposed below the pivot axis. Normally the flap folding plates will be disposed in upright orientation, being maintained in such by the bias applied action of tension springs 94, the springs being connected to the head beam member as at 96 and to the plate first parts as at 98.

Figure 6:
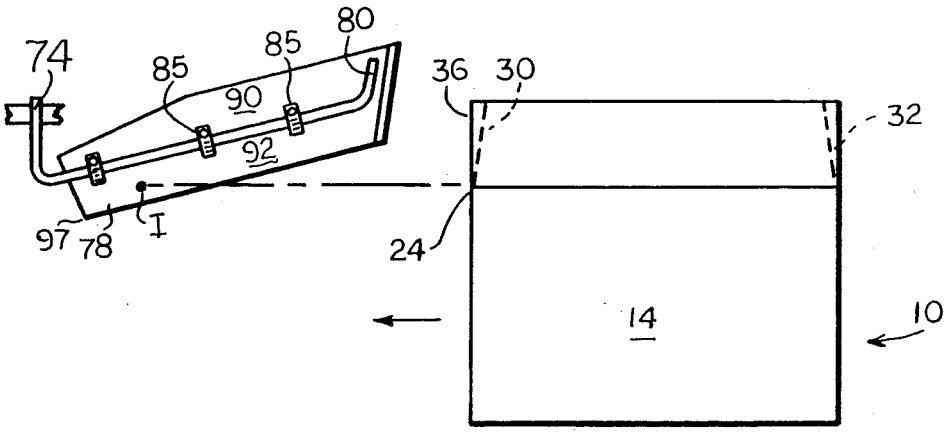
FIG. 6 is a side view depiction illustrating the manner in which a forwardly travelling carton advances into the folding plates with the top corner at the carton front so positioned as to strike the uprightly oriented plates over an appreciable lower portion expanse of said plates and thereby absorb the brunt of impact rather than allow same be transmitted in any consequential measure to the front edges of the carton side flaps.

The invention has as its main purpose, the effective, positive folding of carton side flaps without such being done in anyway that could result in side flap damage and in recognition of what heretofore has been a serious problem of prior devices in causing side flap damage incident engagement of the flaps with the devices as the flap folding causation, looks to utilization of a more rugged structure of the carton as the primary motion producing instrumentality to initiate and sustain flap folding motion. This is as was pointed out earlier achieved by engaging carton corner structure for such purpose. Thus the flap folding plates 76, 78 are arranged, arrayed and sized such that in normal upright orientation of each, the second parts of the plates will have a downward expanse to an extent to insure that the top corner structure of a forwardly travelling carton will engage the plate second parts to initiate folding plate rearward motion. FIG. 6 depicts this and as will be seen, the top corner structures 22, 24 of the forwardly travelling carton 10 are disposed above the lower tip ends 97 of the flap folding plates 76, 78 when the latter are upright and travel along movement line 155 to make impact with the plates at location I. Thus, this, the main impact of the carton structure/plate engagement will be with these carton strengthened parts although the front edges 36 of the side flaps 26, 28 also will engage the plates. Utilization of the top corner structure of the carton to initiate flap folding plate pivoting coupled with the effect of the forwardly travelling carton momentum insures that plate pivoting is provided without recourse to any pivoting effect as might be provided by engagement of the side flap front edges with the folding plates and thus there is consequently an obviating of any tearing or ripping effect on the side flaps which heretofore could occur when said side flaps came into contact forcefully with an abutment as presented by prior folding devices. The manner of operation of the folding apparatus will be described next.

Normally and before the flap folding apparatus 12 is operated, the flap folding plates 76, 78 will be in the upright orientation shown in FIG. 3. A contents-containing carton 10 to be tape sealed in the tape sealing machine 5 will with its side and front and rear flaps extending upwardly, be introduced onto the entrance end of conveyor 42. This may be by reason of an operator placing same there but more usually, it will be a consequence of the in-line continuous flow of filled cartons along an automatic carton sealing operation path. When the carton has moved forwardly to the appropriate location, edge 66 of the head beam will be engaged by and fold down the carton front flap and a sensor means (not shown) will be actuated to operate rear flap kicker 161 to fold the carton rear flap. The carton will thereafter continue forward travel and the top corner structures 22, 24 of the carton will strike the second parts of the folding plates 76, 78 and initiate rearward pivoting of these plates. Only a fraction of a second later, the front edges of the side flaps will engage the folding plates but with a minimized impact effect on the side flaps as the carton corner structures already have absorbed the brunt of the inertial impact of the carton with the folding plates. In pivoting rearwardly, the folding plates are in contact with the side flap front edges and their pivoting movement is transmitted to the side flaps as a folding force to fold these side flaps downward and inward. FIGS. 1 and 2 depict an intermediate folded position of the side flaps. Continued forward travel of the carton continues to cause pivoting of the folding plates and correspondingly the side flaps until the latter are folded to substantially horizontal disposition. The carton with all its flaps folded downwardly passes to the taping station at which the carton is taped and it thereafter passes onto the discharge end of the conveyor.

The above description deals with flap folding at the top of a carton and assumes a carton's bottom side flaps previously were folded as a result of case erection operation and/or carton presence at contents loading station or operation. The folding apparatus of the invention as one skilled in the art readily sees, can be used to fold the bottom side flaps in the same manner and with the same folding plates except such plates would be of reversed character as compared to the plates used for top side flap folding. A carton blank could be partly erected at a station and have all its top flaps and the bottom side flaps left extending in generally vertically directed disposition, but the bottom minor flaps would be folded. The partly erected carton then would be placed on a support such as a T-shaped member and be transported along on the support by belts engaging the carton side walls. A folding apparatus would be located along the travel path of the carton, being set below that path so it can operate to fold the carton bottom major flaps in the same way that the top ones will be later folded. The folding apparatus will be in all respects the same as that for top folding except for reversal of the positioning of the components, e.g., the plate second part of the bottom folding plates will when these plates are in vertical orientation will be above the first part since it is that plate part which the carton bottom front corners will strike. In this regard it is noted that it is the part of the plates which is proximal the carton as distinguished from that remote from the carton when the plates are vertically oriented that the carton corner structures will engage.

It will be understood that various modifications can be made in the flap folding apparatus described above without departing from the scope of the inventive concept disclosed.

What is claimed is:

1. In a carton taping machine including a conveyor which defines a path of carton forward travel along which a rectangular shipping carton can be transported from a conveyor entrance end to a conveyor discharge end, said carton having opposed carton side walls joined at opposite ends of each with respective carton front and rear walls, juncture of said carton side and front and rear walls presenting carton top and bottom corner structure at each side of the carton, said carton further having side flaps extending upwardly from the carton side walls, said machine including carton tape sealing mechanism downstream from the conveyor entrance end, apparatus for folding down and inward the upwardly extending side flaps to closed lateral positions, said apparatus being upstream the tape sealing mechanism and comprising head beam structure including support means supporting the head beam structure above the conveyor, a pair of flap folding plates rotatably mounted on the head beam structure for pivoting of each about a respective one of an associated pair of axes which axes extend obliquely down in the carton forward travel direction and converge toward each other, and bias means connected to said plates and operable to normally maintain said plates disposed in upright orientation, the mounting of the plates being such that when in upright orientation a first part of each plate extends above its associated pivot axis and a second part below said associated axis, the plates in upright orientation disposing such that front edges of the upwardly extending carton side flaps of a forwardly travelling carton can engage with said plates, the second parts of said plates when said plates are in upright orientation extending below their associated pivot axes to an extent that the top corner structures at the sides of the front of said forwardly travelling carton engage said second plate parts thereby initiating a counter bias pivoting movement of said plates moving the plate first parts in a rearward direction against the carton side flaps for folding said flaps to a closed lateral disposition relative to the carton side walls.

2. Flap folding apparatus in accordance with claim 1 in which the flap folding plates axes are defined by and comprise elongated rods fixed to the head beam structure, the flap folding plates being rotatably mounted on the rods.

3. Flap folding apparatus in accordance with claim 2 in which sleeve means are carried on said plates, the elongated rods being received in said sleeve means.

4. Flap folding apparatus in accordance with claim 1 in which the bias means comprises tension springs connected to said plates and to said head beam structure.

5. Flap folding apparatus in accordance with claim 1 in which a front flap extends upwardly from the front wall of the carton, the head beam structure being an elongated member disposed longitudinally of the conveyor, a rear end of the said elongated member being disposed rearwardly a distance of said flap folding plates and presenting a front flap folding shoe for folding down and rearward to lateral position the said front flap of the forwardly travelling carton in advance of the engagement of said top corner structures of the carton with said flap folding plates.

6. Flap folding apparatus in accordance with claim 1 in which the head beam structure is mounted adjustably on said support means for adjusting the height of the head beam structure above said conveyor over a range of heights for using the apparatus with cartons having a corresponding range of heights.

7. Flap folding apparatus for folding side flaps which extend vertically from each one of an opposed pair of carton side walls of a carton travelling in a forwardly directed travel course inwardly of the carton side walls to lateral positions, said apparatus comprising a pair of flap folding plates, means for supporting said plates for rotatable movement about a respective one of an associated pair of axes which axes extend obliquely of the carton travel path and converge toward each other, and bias means connected to said plates and operable to normally maintain said plates disposed in upright orientation, the mounting of said plates being such that when in upright orientation a first part of each plate extends above its associated pivot axis and a second part below, the plates in upright orientation disposing such that corner structure at the front of said carton will engage an upright plate part proximal the carton travel course to initiate a counter bias pivoting movement of said plate moving its other part in a rearward direction against a carton side flap for folding said side flaps to a closed lateral disposition relative to the carton side walls.

8. Apparatus for folding a carton side flap extending vertically from its associated carton side wall to lateral inward disposition relative to said side wall as the carton is travelling along a straight line travel course, said apparatus comprising a plate mounted for pivoting about an axis obliquely inclined to the carton travel course and converging from a side of the travel course toward the centerline of said course, and bias means engaged with said plate and normally urging said plate into an upright orientation, said plate in said orientation having a first part disposed above the pivot axis and a second part below the pivot axis, the plate being disposed such that a corner structure of said carton comprised by intersection of said carton side wall with a carton front wall will when said carton is travelling forwardly strike one plate part of the upright plate to initiate counter bias pivoting of said plate thereby moving its other part in a rearward direction against the side flap and with said movement fold said flap to flat folded lateral disposition.

* * * * *